US011840892B2

(12) United States Patent
Simionescu

(10) Patent No.: US 11,840,892 B2
(45) Date of Patent: Dec. 12, 2023

(54) HAND-ACTUATED EARTH AUGER

(71) Applicant: Petru Aurelian Simionescu, Corpus Christi, TX (US)

(72) Inventor: Petru Aurelian Simionescu, Corpus Christi, TX (US)

( * ) Notice: Subject to any disclaimer, the term of this patent is extended or adjusted under 35 U.S.C. 154(b) by 244 days.

(21) Appl. No.: 17/406,977

(22) Filed: Aug. 19, 2021

(65) Prior Publication Data

US 2023/0053768 A1 Feb. 23, 2023

(51) Int. Cl.
*E21B 11/00* (2006.01)
*E21B 10/44* (2006.01)

(52) U.S. Cl.
CPC ..... *E21B 11/005* (2013.01); *E21B 10/44* (2013.01)

(58) Field of Classification Search
CPC ..... E21B 11/005; E21B 10/44
USPC ..... 173/18–19
See application file for complete search history.

(56) References Cited

U.S. PATENT DOCUMENTS 22,046 A * 11/1858 White et al. ..... E21B 7/02 173/39
396,018 A * 1/1889 Woolworth ..... B23Q 5/32 173/39
519,642 A * 5/1894 Ream et al. ..... E21B 27/00 175/242
877,597 A * 1/1908 Rickles ..... E21B 11/005 173/30
924,743 A * 6/1909 Cox et al. ..... B23Q 5/32 173/39
1,303,790 A * 5/1919 Gilman ..... A47B 91/04 173/31
1,515,924 A * 11/1924 Dink ..... B27C 3/08 408/124
2,113,488 A * 4/1938 Milton ..... A63G 11/00 403/90
2,173,300 A * 9/1939 Heldman ..... A63G 13/08 248/629
2,210,628 A * 8/1940 Mantini ..... E21B 15/006 173/39
2,844,139 A * 7/1958 Lucas ..... A47J 33/00 126/30
2,908,483 A * 10/1959 Stephenson ..... A01C 5/02 173/21
2,977,953 A * 4/1961 Dowdy ..... A47J 37/0763 126/30
2,991,838 A * 7/1961 Lane ..... A01C 5/04 175/203

(Continued)

FOREIGN PATENT DOCUMENTS

EP 1296017 A1 * 3/2003 ..... E02D 1/04

*Primary Examiner* — Robert F Long

(57) ABSTRACT

A hand-actuated earth auger of the type used to drill water wells, for taking soil samples, or other similar purposes is disclosed. It consists of a spiral or bladed earth drill, extended with one stem rod consisting of one or more stem segments, and one tee handle mounted on a handle collar. The handle collar can be clamped at any height along the stem rod, while the tee handle can be attached to the handle collar in two configurations, resulting in two different heights of the handle. These features allow the operator to lift the auger out of the ground by doing a seated calf raise in two quick increments, corresponding to the two configurations of the tee handle. It also allows the stem rod to be assembled of fewer, but longer stem segments, thus saving on cost.

6 Claims, 4 Drawing Sheets

(56) References Cited

U.S. PATENT DOCUMENTS 4,075,913 A * 2/1978 Tye ..... H01R 11/14 52/125.4
4,122,905 A * 10/1978 Kanigan ..... A01C 5/02 172/381
4,387,483 A * 6/1983 Larrabee ..... E21B 11/005 175/170
4,400,028 A * 8/1983 Conrad ..... B25B 13/481 403/365
4,553,525 A * 11/1985 Ruble ..... A47J 37/0772 126/30
4,736,804 A * 4/1988 Geibel ..... B25H 1/0035 408/136
5,038,870 A * 8/1991 Kuronen ..... E21B 7/008 175/323
5,060,435 A * 10/1991 Bogdanow ..... E04H 12/2261 52/165
5,244,048 A * 9/1993 Moorhead, Sr. ..... B25H 1/0042 408/136
5,352,170 A * 10/1994 Condo ..... A63B 69/32 482/83
5,388,654 A * 2/1995 Heiss ..... E21B 7/02 175/170
5,487,432 A * 1/1996 Thompson ..... E21B 17/003 175/84
6,076,617 A * 6/2000 Berner ..... E21B 7/008 175/18
6,254,154 B1 * 7/2001 Herzfeld ..... E21B 11/005 294/58
6,321,861 B1 * 11/2001 Leichter ..... E04H 12/2223 175/323
6,578,568 B1 * 6/2003 Dufort ..... F24B 1/205 126/30
7,832,496 B2 * 11/2010 Nakayabu ..... B28D 1/14 173/39
8,272,601 B2 * 9/2012 Kocher ..... A47J 33/00 248/176.1
10,041,301 B2 * 8/2018 Jones ..... E21B 7/027
2005/0205298 A1 * 9/2005 Kollasch ..... F25C 5/04 175/18
2007/0102194 A1 * 5/2007 Wen ..... E21B 11/005 175/135
2007/0129158 A1 * 6/2007 Watts ..... A63G 31/02 472/137
2007/0289587 A1 * 12/2007 Eckes ..... F24B 1/205 126/30
2008/0066966 A1 * 3/2008 Mora ..... E21B 10/44 175/57
2008/0078565 A1 * 4/2008 Paskar ..... E21B 15/006 173/31
2010/0060022 A1 * 3/2010 Alcov ..... A01B 1/24 294/50.7
2011/0225800 A1 * 9/2011 Lacy ..... E02D 17/202 29/525.01
2012/0073877 A1 * 3/2012 Jakubczak ..... E21B 11/005 175/57
2012/0312297 A1 * 12/2012 Walker ..... F24C 1/06 126/9 B
2013/0233625 A1 * 9/2013 Robinson ..... E21B 7/027 175/203
2019/0078387 A1 * 3/2019 Mauldin ..... E21B 7/027

* cited by examiner

HAND-ACTUATED EARTH AUGER

BACKGROUND—PRIOR ART

The following is a tabulation of some prior art that presently appears relevant

| U.S. Pat. No. | Inventors | Date |
|---|---|---|
| 6,970 | Dow | Dec. 25, 1849 |
| 181,983 | Pulse | Sep. 5, 1876 |
| 256,039 | Peters | Apr. 4, 1882 |
| 537,157 | Iwan et al. | Apr. 9, 1895 |
| 570,810 | Meier | Nov. 3, 1896 |
| 677,403 | Driskill | Jul. 2, 1901 |
| 814,850 | Kemmerer | Mar. 1, 1906 |
| 849,957 | Zwiebel | Apr. 1, 1907 |
| 933,227 | Billau | Sep. 1, 1909 |
| 1,053,730 | Jensen | Feb. 1, 1913 |
| 1,076,817 | Chase | Oct. 28, 1913 |
| 1,110,517 | Watkins et al. | Sep. 15, 1914 |
| 1,114,206 | Watkins et al. | Oct. 20, 1914 |
| 1,142,646 | Watkins et al. | Jun. 8, 1915 |
| 1,470,284 | Pooler | Oct. 1, 1923 |
| 1,692,436 | Deane | Nov. 1, 1928 |
| 2,021,982 | Byrne | Nov. 26, 1935 |
| 2,571,244 | Hollander | Mar. 12, 1949 |
| 2,606,055 | Johnson | Aug. 1, 1952 |
| 2,708,593 | Benoist | May 1, 1955 |
| 2,802,689 | Batstone | Aug. 1, 1957 |
| 5,209,534 | Crenshaw et a. | May 11, 1993 |

NONPATENT LITERATURE DOCUMENTS

Grandjean, E. *Fitting the task to the Man: An ergonomic approach*. Taylor & Francis Ltd. London, UK, 1980.

1. TECHNICAL FIELD

The present invention relates to well drilling and soil sampling, and more particularly it relates to a hand-actuated earth auger, the tee handle of which can be clamped at any height along the stem rod, thus allowing the operator to more ergonomically use the auger, and in particular to lift the auger out of the ground by doing a seated calf raise. It is known that seated calf raises allow a regular person to lift easily more than twice his or her own body weight, an ability useful when pulling the auger out of wet clay or wet sand.

2. BACKGROUND ART

Hand-actuated earth augers of the type used to drill water wells, for taking soil samples, or other similar purposes, consist of one spiral or bladed earth drill, extended with one stem rod which ends with a tee handle. The stem rod is assembled form one or more stem segments, each segment being approximately four feet long.

Of the known hand-actuated earth augers, the one disclosed in U.S. Pat. No. 256,039 allows the stem segment ending with the tee handle to be telescopically adjusted in height for improved ergonomics. As disclosed however, the operator is unable to pull the auger out of wet clay or wet sand by doing a seated calf rise, because the height of the tee-handle can be adjusted only with the earth drill removed from the ground.

3. OBJECTS AND SUMMARY OF THE PRESENT INVENTION

It is the object of the present invention to provide a hand-actuated earth auger which allows the operator to more ergonomically use the auger, and in particular to lift it out of the ground by doing a seated calf raise, with the tee handle positioned across his upper legs.

Another object of the present invention is to provide a hand-actuated earth auger the stem rod of which, or the individual stem segments, can be made longer, thus reducing cost by employing fewer stem-segment connectors.

These and other objects are obtained in accordance with the present invention wherein there is provided a hand-actuated earth auger consisting of a spiral or bladed earth drill, extended with one stem rod composed of one or more stem segments, and one tee handle provided with a handle collar. The handle collar of the tee handle can be clamped at any position along the stem rod, and also allows the tee handle to be configured in two ways, resulting in two different heights of the tee handle measured from the tip of the auger. Such features allow the operator to lift the auger out of the ground by doing a seated calf raise in two quick increments, resulting in superior force-lifting abilities, particularly useful when pulling the auger out of wet clay or wet sand.

4. BRIEF DESCRIPTION OF THE DRAWINGS

Further objects of the present invention will become apparent from the following description of preferred embodiments with reference to the accompanying drawings in which.

5. DESCRIPTION OF THE PREFERRED EMBODIMENTS

Figure 1:
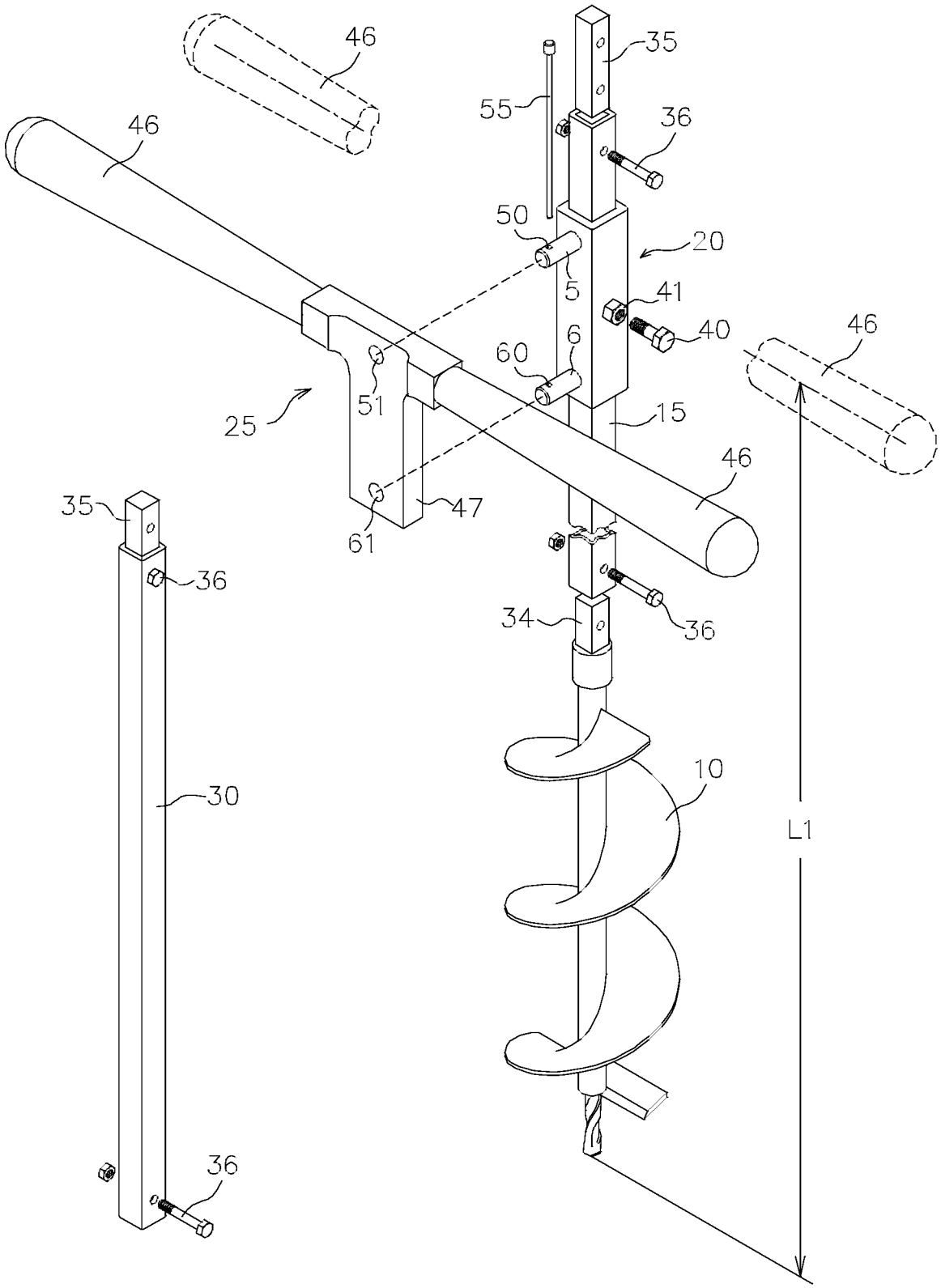
FIG. 1 is an exploded, three-dimensional view of the hand-actuated earth auger in accordance with the present invention equipped with a stem rod having a square cross section, also showing the tee handle configured such that a longer tip-to-handle distance L1 is achieved.
Figure 2:
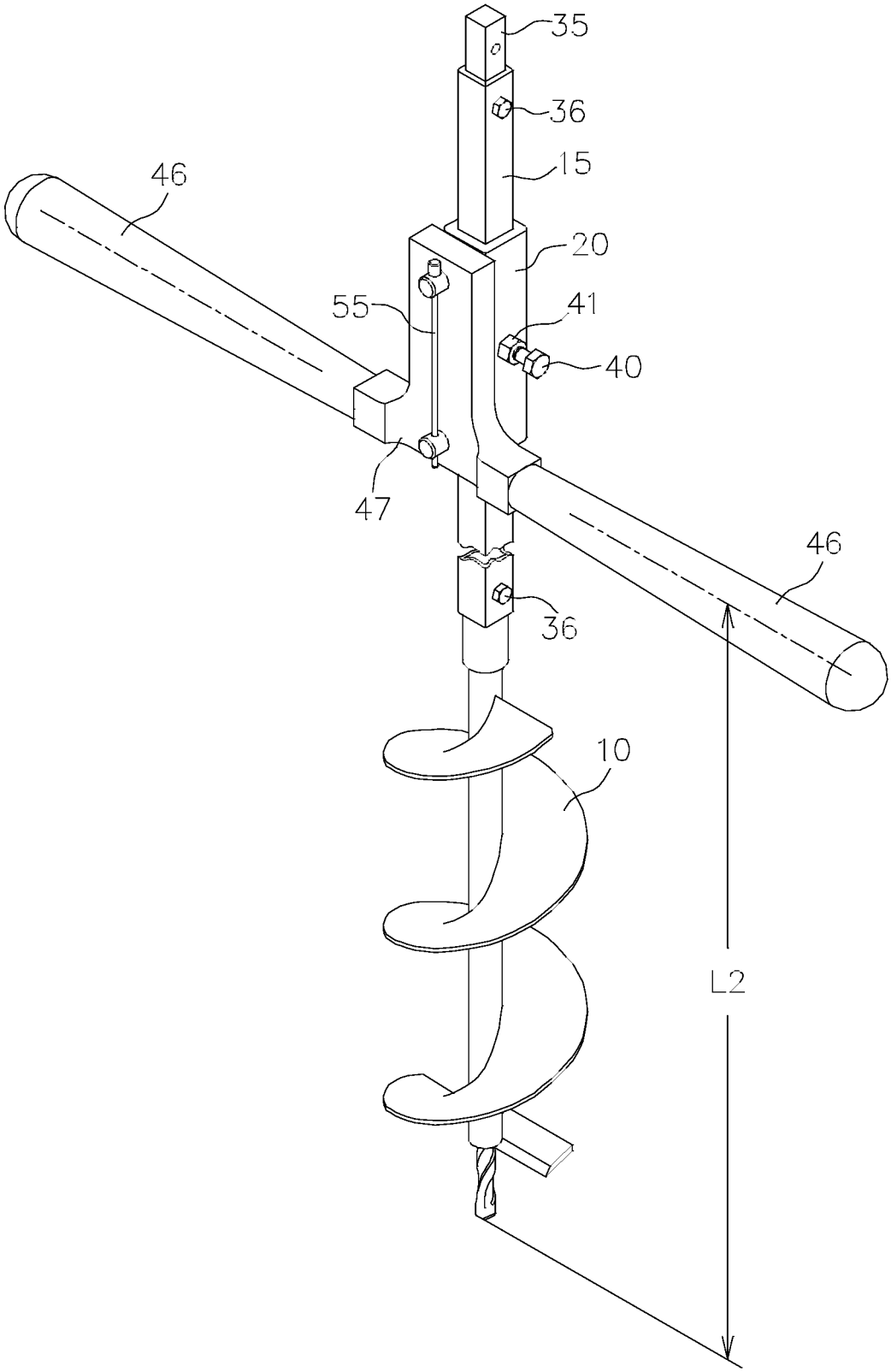
FIG. 2 is a three-dimensional view of the hand-actuated earth auger in accordance with the present invention, showing the tee handle configured such that a shorter tip-to-handle distance L2 is achieved

FIGS. 1 and 2 show a preferred embodiment of the hand-actuated earth auger according to the present invention, consisting of an earth drill 10, a stem rod 15, a handle collar 20 and a tee-handle 25. The stem rod 15 has square cross section and assembles with earth drill 10 via a connector end 34 and a bolt 36.

Stem rod 15 can be fabricated in one piece or can be assembled from multiple stem segments 30 by means of connectors 35, and of bolts 36.

Handle collar 20 can be clamped at any location along stem rod 15 with the help of clamping bolt 40 which threads into a nut 41 welded on the side of handle collar 20. In another embodiment of the present invention, nut 41 is welded on the edge of handle collar 20, such that the axis of clamping bolt 40 is contained in the diagonal plane of stem rod 15. As it is apparent to a person having ordinary skill in the art, in order for clamping bolt 40 to engage stem rod 15 when tightened, a sufficiently large hole aligned with the axis of nut 41 must be practiced into handle collar 20 before said nut is welded in place.

Tee handle 25 consists of a pair of handlebars 46 and a central bracket 47 fastened together by welding or by other means, or are fabricated in one piece.

Central bracket 47 is provided with a pair of holes 51 and 61 which serve to assemble securely tee handle 25 with handle collar 20 by means of pins 5 and 6 and of a long pin 55. Pins 5 and 6 are provided each with transverse small holes 50 and 60, and are solidly attached to the side of handle collar 20. Pins 5 and 6 are oriented such that they can be inserted through holes 51 and 61 as suggested by the two parallel dashed lines in FIG. 1, resulting in a hand-actuated earth auger assembly as shown in FIG. 2.

For the hand-actuated earth auger ready for use having the handle collar 20 clamped at a desired location along stem rod 15, and for tee handle 25 secured in place using long pin 55, a distance L1 can be measured between the tip of earth drill 10 and the longitudinal axis of handlebars 46.

FIG. 2 shows the hand-actuated earth auger of the present invention ready to use, where tee-handle 25 is assembled with handle collar 20 in a flipped position, such that distance L2 measured between the tip of earth drill 10 and the longitudinal axis of handlebars 46 is shorter than distance L1 by an amount equal to the active length of long pin 55.

Figure 3:
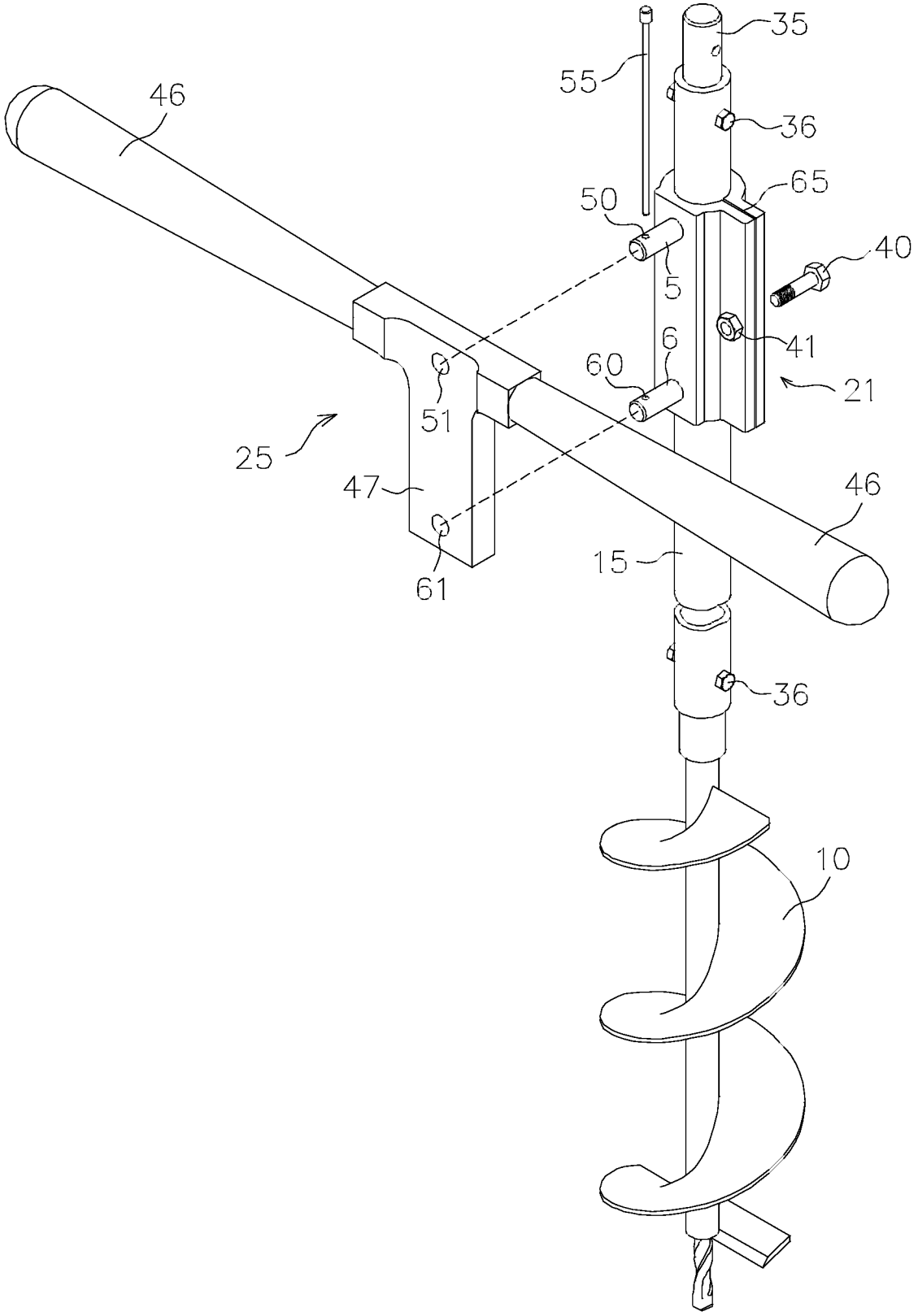
FIG. 3 is an exploded, three-dimensional view of the hand-actuated earth auger in accordance with the present invention equipped with a circular cross-section stem rod.

FIG. 3 shows another embodiment of the hand-actuated earth auger according to the present invention where stem rod 15 and their connectors 36 have circular rather than square cross sections. More compatible with a cylindrical stem rod 15, a handle collar 21 it is provided which ensures clamping through friction for both turning and the puling earth drill 10. As recognized by a person of ordinary skill in the art familiar with bicycle saddle adjustments, the desired clamping is the results of closing a slit 65 practiced on one side of handle cleave 21 under the effect of tightening clamping bolt 40 against nut 41.

Figure 4:
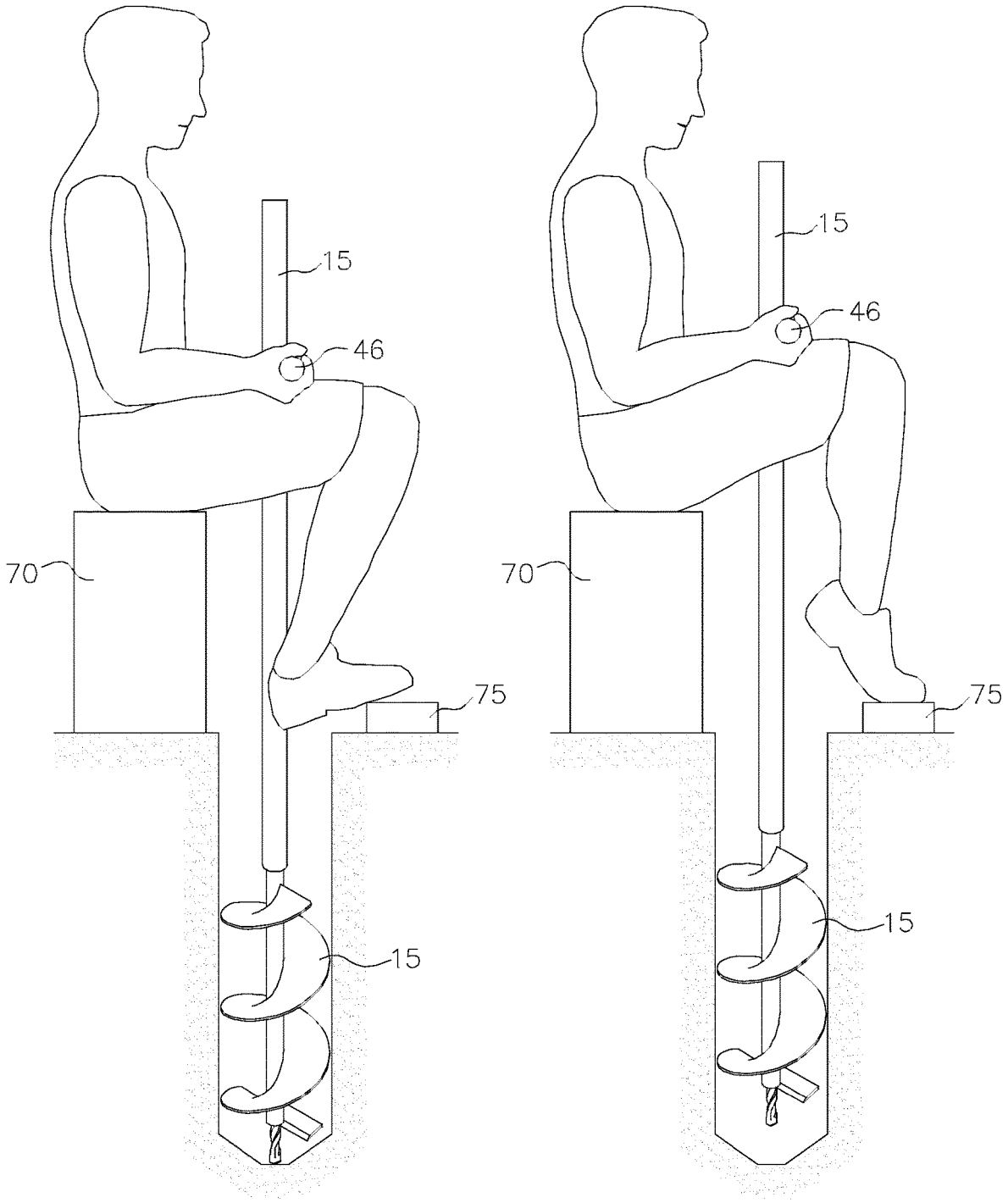
FIG. 4 shows the hand-actuated earth auger of the present invention as it is lifted off the ground by an operator doing a seated calf raise, with the tee handle positioned across his upper legs.

FIG. 4 shows an operator of the hand-actuated earth auger of the present invention as he is lifting the earth drill off the ground by doing a seated calf raise. To achieve maximum lifting force, the operator seats on a stool 70, and rests his feet on a rectangular wood block 75 of about two feet long. Wood block 75 can be replaced with a pair of shorter rectangular blocks, in particular with a pair of clay bricks. The operator then adjusts the location of the tee handle 25 along stem rod 15, such that handlebars 46 are positioned in contact with his upper legs. For the first lift, the tee handle 25 is configured for a bigger distance L1 as shown in FIG. 1. After the first successful lift of the earth drill, the tee handle 25 is configured for a smaller distance L2 as shown in FIG. 2 and the seated calf raise maneuver is repeated. Such a dual maneuver is sufficient to unstick the earth drill out of wet sand or claw, after which lifting the auger out of the ground can be completed in a conventional way.

While preferred embodiments of the invention have been particularly described in the specification and illustrated in the accompanying drawing, it should be understood that the invention is not so limited. Many modifications, equivalents and adaptations are possible without departing from the spirit and scope of the invention as defined in the following claims:

What is claimed is:

1. A hand-actuated earth auger comprising:

an earth drill extended with a stem rod;

a handle-collar clamped on the stem-rod;

a tee-handle attached to the handle-collar via a central bracket provided with a pair of holes which serve to assemble securely tee handle with handle collar by at least one pin attached to the side of handle collar and a long pin;

wherein the handle collar is capable of being clamped at any location along said stem rod, thereby allowing a person to adjust the height of the tee-handle with respect to the earth drill; and wherein the tee handle is configured to be attached on the handle collar in two ways, corresponding to two different heights $L_1$ and $L_2$ of the tee handle measured from the tip of the earth drill.

2. The hand-actuated earth auger of claim 1, wherein the tee-handle is configured to be attached on the handle-collar at a first position corresponding to one of the two ways and at a second position, rotated by 180 degrees, corresponding to the other of the two ways;

wherein, when the handle collar is clamped at a certain location on the stem rod, the first position corresponds to a first height $L_1$ of the tee handle measured from the tip of the earth drill;

wherein, when the handle collar is clamped at the certain location on the stem rod, the second position corresponds to a second height $L_2$ of the tee handle measured from the tip of the earth drill, such as $L_1$ is different than $L_2$.

3. The hand-actuated earth auger of claim 1, wherein the height of the tee-handle with respect to the tip of the drill can be adjusted to two different heights $L_1$ and $L_2$ without changing the location of the handle-collar on the stem-rod.

4. The hand-actuated earth auger of claim 1, wherein the handle collar is capable of being clamped at any location along said stem rod without removing the auger from the ground.

5. The hand-actuated earth auger of claim 1, wherein the hand-actuated earth auger is configured to allow an operator to lift the auger out of the ground by doing a seated calf raise.

6. The hand-actuated earth auger of claim 1, wherein the hand-actuated earth auger is configured to allow an operator to lift the auger out of ground by doing a seated calf raise in two increments, corresponding to the two configurations of the tee handle.

* * * * *